US011732390B2

(12) United States Patent
Ishikawa

(10) Patent No.: US 11,732,390 B2
(45) Date of Patent: Aug. 22, 2023

(54) SEWING MACHINE THREADING DEVICE

(71) Applicant: SUZUKI MANUFACTURING, LTD., Yamagata (JP)

(72) Inventor: Masato Ishikawa, Yamagata (JP)

(73) Assignee: SUZUKI MANUFACTURING, LTD., Yamagata (JP)

( * ) Notice: Subject to any disclaimer, the term of this patent is extended or adjusted under 35 U.S.C. 154(b) by 100 days.

(21) Appl. No.: 17/613,116

(22) PCT Filed: Jun. 18, 2020

(86) PCT No.: PCT/JP2020/024004
§ 371 (c)(1),
(2) Date: Nov. 22, 2021

(87) PCT Pub. No.: WO2021/106252
PCT Pub. Date: Jun. 3, 2021

(65) Prior Publication Data

US 2022/0282415 A1 Sep. 8, 2022

(30) Foreign Application Priority Data

Nov. 28, 2019 (JP) ..... 2019-215170

(51) Int. Cl.
*D05B 87/02* (2006.01)

(52) U.S. Cl.
CPC ..... *D05B 87/02* (2013.01)

(58) Field of Classification Search
CPC ..... D05B 87/00; D05B 87/02; D05B 87/04
USPC ..... 112/224; 223/99
See application file for complete search history.

(56) References Cited

U.S. PATENT DOCUMENTS

| | | | | |
|---|---|---|---|---|
| 5,086,719 | A * | 2/1992 | Ogawa | D05B 55/14 112/225 |
| 5,092,257 | A * | 3/1992 | Ogawa | D05B 87/02 112/225 |
| 6,067,919 | A * | 5/2000 | Shoji | D05B 87/02 112/225 |
| 2002/0073904 | A1 * | 6/2002 | Sano | D05B 87/02 112/302 |

(Continued)

FOREIGN PATENT DOCUMENTS

| | | | |
|---|---|---|---|
| JP | H03251292 | A | 11/1991 |
| JP | H05007684 | A | 1/1993 |

(Continued)

*Primary Examiner* — Nathan E Durham
(74) *Attorney, Agent, or Firm* — Bacon & Thomas, PLLC

(57) ABSTRACT

Provided is a sewing machine threading device that is compactly configured, and that is capable of preventing a thread hooking claw from disturbing sewing work. When an up-and-down movement operation lever 9 is raised, a thread hooking claw 10 is located above a sewing needle not to disturb sewing work. When the up-and-down movement operation lever 9 is lowered, a sliding member 15 slides along a thread hooking guide shaft 16 to cause the thread hooking claw 10 to be lowered together with a thread hooking support rod 13, rotating unit 23 rotates the thread hooking claw 10 from behind the sewing needle toward an eye of the sewing needle in connection with lowering of the thread hooking support rod 13, and the thread hooking claw 10 is inserted into the eye of the sewing needle.

2 Claims, 10 Drawing Sheets

(56) References Cited

U.S. PATENT DOCUMENTS

| | | | | |
|---|---|---|---|---|
| 2005/0022709 | A1* | 2/2005 | Yoshikazu | D05B 87/02 112/225 |
| 2009/0013912 | A1* | 1/2009 | Miyoshi | D05B 87/02 112/225 |
| 2009/0183663 | A1* | 7/2009 | Fujihara | D05B 87/02 112/225 |
| 2010/0043686 | A1* | 2/2010 | Suzuki | D05B 87/02 112/225 |
| 2010/0071603 | A1* | 3/2010 | Miyoshi | D05B 87/02 112/225 |
| 2015/0013582 | A1* | 1/2015 | Osanai | D05B 47/04 112/225 |
| 2015/0259840 | A1* | 9/2015 | Osanai | D05B 87/02 112/225 |
| 2015/0330006 | A1* | 11/2015 | Suzuki | D05B 87/02 112/225 |
| 2021/0148027 | A1* | 5/2021 | Azuma | D05B 87/02 |

FOREIGN PATENT DOCUMENTS

| | | | |
|---|---|---|---|
| JP | H05293284 | A | 11/1993 |
| JP | H053 17563 | A | 12/1993 |
| JP | H1076093 | A | 3/1998 |
| JP | 2001327787 | A | 11/2001 |
| WO | WO2012073893 | A1 | 6/2021 |

* cited by examiner

SEWING MACHINE THREADING DEVICE

TECHNICAL FIELD

The present invention relates to a threading device that is provided in a sewing machine including a plurality of sewing needles to thread an eye of each of the sewing needles.

BACKGROUND ART

In the related art, a threading device is provided in a sewing machine in order to reduce the work of threading an eye of a sewing needle of the sewing machine.

This type of threading device is configured to perform an operation of lowering a thread hooking claw to a position corresponding to an eye of a sewing needle and of inserting the thread hooking claw into the eye, and an operation of pulling the thread hooking claw out from the eye and of raising the thread hooking claw to a retracted position behind and above the sewing needle (refer to Patent Literature 1).

These operations are performed when a user operates an operation lever. Namely, the user operates and lowers the operation lever to hook a thread on the thread hooking claw inserted into the eye, and raises the operation lever to complete the work of threading the eye.

The thread hooking claw is supported by a lower end of a thread hooking support rod. The thread hooking support rod extends parallel to a needle bar in an up-and-down direction and is supported by an attachment member, the needle bar supporting the sewing needle. The attachment member is fixed to a sewing machine body, and supports the thread hooking support rod so as to be movable in the up-and-down direction.

When the operation lever is operated to be lowered, the thread hooking claw is lowered with downward extension of the thread hooking support rod. Next, when the operation lever is operated to be raised, the thread hooking claw is raised with an upward movement of the thread hooking support rod.

Further, the attachment member supports the thread hooking support rod so as to be rotatable around an axis of the thread hooking support rod. A rotating unit is connected to the thread hooking support rod. The rotating unit rotates the thread hooking support rod in synchronization with an up-and-down movement of the thread hooking support rod. Accordingly, the thread hooking support rod rotates synchronously with the lowering and the raising of the thread hooking claw. The thread hooking claw is turned and inserted into and removed from the eye by rotation of the thread hooking support rod.

In addition, the thread hooking claw can be selectively moved to one of positions corresponding to eyes of a plurality of sewing needles. Accordingly, the threading hooking claw is suitably provided in an overlock sewing machine including a plurality of sewing needles, and the work of threading the plurality of sewing needles can be reduced.

CITATION LIST

Patent Literature

Patent Literature 1: Japanese Patent Application Laid-Open No. H5-7684

SUMMARY OF INVENTION

Technical Problem

By the way, examples of a sewing machine including a plurality of sewing needles include a coverstitch sewing machine in addition to an overlock sewing machine. Since the coverstitch sewing machine also requires the work of threading a plurality of sewing needles, it is desirable that the threading device is provided to reduce threading work.

However, in the threading device of the related art, even when the thread hooking claw is raised and retracted during sewing work, the thread hooking claw is exposed behind and above the vicinity of the sewing needles. Therefore, in sewing work by the coverstitch sewing machine, the exposed thread hooking claw becomes an obstacle, which is a concern.

Namely, in the threading device of the related art, the thread hooking support rod that supports the thread hooking claw is directly supported by the attachment member fixed to the sewing machine body, and moves up and down over the total length of the thread hooking support rod. Moreover, the thread hooking support rod also has to secure a region of connection to the rotating unit or the operation lever, and providing a thread hooking support rod having a dimension longer than a distance of raising and lowering of the thread hooking claw is required.

For this reason, even when the thread hooking support rod is accommodated to the maximum extent inside a housing of the sewing machine, the thread hooking claw is difficult to accommodate inside the housing of the sewing machine, and the thread hooking claw raised to the retracted position is exposed behind and above the vicinity of the sewing needles.

On the other hand, when the coverstitch sewing machine is used to apply a coverstitch around a cuff and a collar of a cloth, a fabric is frequently rotated in the vicinity of the sewing needles by manual work. At this time, when the thread hooking claw in a retracted state is exposed in the vicinity of the sewing needles, the fabric rotated in the vicinity of the sewing needles may be hooked on the thread hooking claw, or the fingers of a worker may come into contact with the thread hooking claw, which disturbs sewing work.

Then, in order to retract the thread hooking claw to a position at which the thread hooking claw is not exposed while maintaining the configuration of the threading device in the related art, securing a space capable of accommodating both the thread hooking support rod and the thread hooking claw inside the housing of the sewing machine is required, and the size of the sewing machine is increased, which is a concern.

In view of the above points, an object of the present invention is to provide a sewing machine threading device that is compactly configured, and that is capable of preventing a thread hooking claw from disturbing sewing work.

Solution to Problem

In order to achieve this object, according to an aspect of the present invention, there is provided a threading device that is provided in a sewing machine including a plurality of sewing needles to thread an eye of each of the sewing needles, the device including: a fixed frame fixed to a machine frame of the sewing machine; a support frame that is laterally movably held by the fixed frame; a thread hooking guide shaft of which upper and lower ends in a longitudinal direction are fixed to the support frame; a sliding member that is slidably held by the thread hooking guide shaft; a thread hooking support rod of which an upper end portion is connected to the sliding member, that supports a thread hooking claw via a lower end portion, and that extends parallel to the thread hooking guide shaft in an up-and-down direction, the thread hooking claw having a shape to be insertable into and removable from the eye of the sewing needle; an up-and-down movement operation lever configured to move the thread hooking support rod up and down along the thread hooking guide shaft via the sliding member; a rotating unit configured to rotate the thread hooking support rod around an axis of the thread hooking guide shaft via the sliding member; a lateral movement operation lever configured to move laterally the support frame to cause the thread hooking claw to correspond selectively to any one of the sewing needles; and a stopping unit configured to stop a lateral movement of the support frame when the thread hooking claw is at a lowered position. The thread hooking support rod is set to be equal to or less than a length of the thread hooking guide shaft. When the up-and-down movement operation lever is at a raised position, the thread hooking claw is at a retracted position above the sewing needle. When the up-and-down movement operation lever is lowered, the sliding member slides along the thread hooking guide shaft to cause the thread hooking claw to be lowered together with the thread hooking support rod, the rotating unit rotates the thread hooking claw from behind the sewing needle toward the eye of the sewing needle in connection with lowering of the thread hooking support rod, and the thread hooking claw is inserted into the eye of the sewing needle. The stopping unit allows a lateral movement of the support frame when the up-and-down movement operation lever is at the raised position, and stops a lateral movement of the support frame prior to lowering of the thread hooking support rod when a downward movement operation of the up-and-down movement operation lever is started.

According to the present invention, when the lateral movement operation lever is operated to move laterally the support frame, it is possible to select which sewing needle the thread hooking claw is used for. Next, when the up-and-down movement operation lever is lowered, the thread hooking claw can be inserted into an eye of the selected sewing needle, and a thread can be hooked on the thread hooking claw.

The sliding member fixed to the support frame slides along the thread hooking guide shaft as the up-and-down movement operation lever is operated to be lowered or raised. Since the thread hooking support rod is connected to the sliding member, the thread hooking support rod and the thread hooking claw move integrally with the sliding member.

The thread hooking claw supported by the lower end portion of the thread hooking support rod moves the same distance as a movement distance of the sliding member. The movement distance of the sliding member corresponds to the length of the thread hooking guide shaft fixed to the support frame. Then, since the upper end portion of the thread hooking support rod is connected to the sliding member, even when the sliding member is located at an upper end (top dead center) of the thread hooking guide shaft, the thread hooking support rod does not extend above the thread hooking guide shaft.

Further, since the length of the thread hooking support rod is set to be equal to or less than the length of the thread hooking guide shaft, when the sliding member is located at the upper end (top dead center) of the thread hooking guide shaft, the thread hooking support rod can be accommodated within a range of the length of the thread hooking guide shaft. Namely, unlike a configuration in the related art in which the thread hooking support rod is moved up and down without providing the thread hooking guide shaft and the sliding member, in the present invention, since the thread hooking guide shaft and the sliding member are provided, the thread hooking support rod can be made shorter than in the related art, and the configuration of the device becomes compact.

Therefore, when the thread hooking claw is at a retracted position, the thread hooking support rod can be stored in a small space, and the thread hooking claw can be retracted to a position at which sewing work is not disturbed (specifically, for example, inside a housing of the sewing machine above the sewing needle).

Then, in the case where the retracted position of the thread hooking claw is provided inside the housing of the sewing machine of the sewing needle, the thread hooking claw at the retracted position does not become an obstacle even when a fabric is handled in the vicinity of the sewing needle during sewing work. Therefore, the thread hooking claw can be suitably adopted for a coverstitch sewing machine.

Further, since the stopping unit is provided, when the thread hooking claw is at the lowered position, a lateral movement of the support frame is stopped. Accordingly, when the work of hooking a thread on the sewing needle is performed, the support frame does not move laterally in a state where the thread hooking claw is inserted into the eye of the sewing needle, and damage or the like to the thread hooking claw or the sewing needle can be prevented.

Moreover, since the stopping unit stops a lateral movement of the support frame when a downward movement operation of the up-and-down movement operation lever is started, even if a user operates and lowers the up-and-down movement operation lever and a push-down force is applied in a lateral direction, an inadvertent lateral movement of the support frame can be prevented.

In addition, in the sewing machine threading device of the present invention, an up-and-down movement of the sewing needle of the sewing machine is driven by rotation of a driving force transmission shaft, and the sewing machine threading device further includes locking unit configured to be locked to the driving force transmission shaft in response to a lowering operation of the up-and-down movement operation lever to lock rotation of the driving force transmission shaft.

Since the locking unit is provided, when the thread hooking claw is moved to the lowered position by a lowering operation of the up-and-down movement operation lever, the driving force transmission shaft is locked. Accordingly, the sewing needle does not inadvertently move up and down during threading work, and damage or the like to the thread hooking claw or the sewing needle can be prevented.

DESCRIPTION OF EMBODIMENTS

Figure 1:
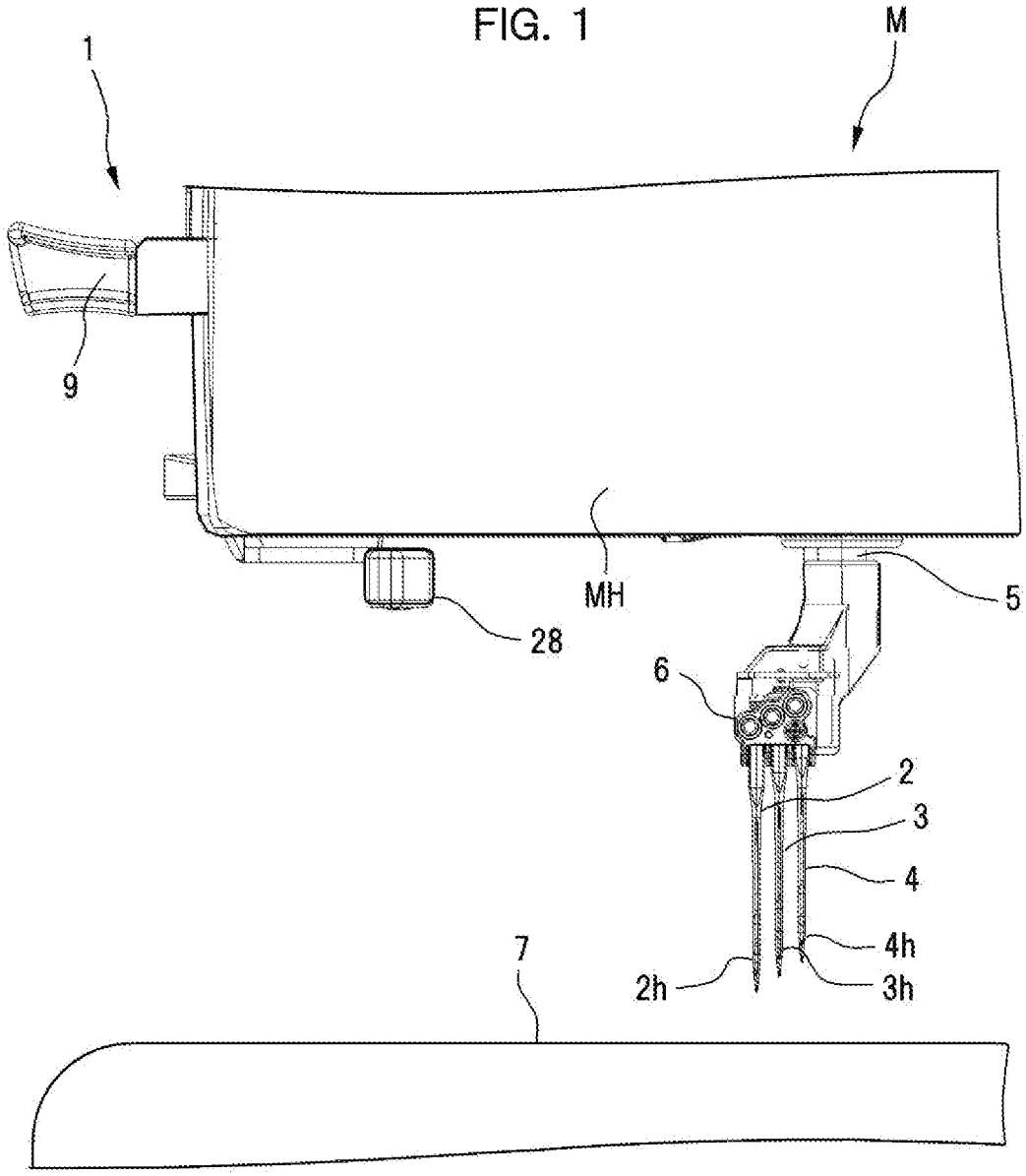
FIG. 1 is a descriptive front view illustrating a main part of a sewing machine of an embodiment of the present invention in a state where a thread hooking claw is raised.

One embodiment of the present invention will be described with reference to the drawings. In the present embodiment, a threading device 1 of the present invention is provided in a coverstitch sewing machine M (hereinafter, referred to as the sewing machine M) that is partially illustrated in FIGS. 1 and 2. The sewing machine M includes three sewing needles 2, 3, and 4. The sewing needles 2, 3, and 4 are attached and fixed to a needle clamp 6 at a lower end of a needle bar 5. Incidentally, the sewing machine M includes a feed dog protruding from an upper surface of a throat plate 7, and a presser foot facing an upper side of the feed dog; however, these components are not illustrated in FIGS. 1 and 2.

The needle bar 5 is moved up and down by the driving of a main shaft 8 (refer to FIG. 6) that is a driving force transmission shaft to be described later. A rotation conversion mechanism (not illustrated) that converts the rotation of the main shaft 8 into a reciprocating movement in an up-and-down direction is provided between the main shaft 8 and the needle bar 5. The sewing needles 2, 3, and 4 move up and down integrally with the needle bar 5.

The main shaft 8 not only drives an up-and-down movement of the sewing needles 2, 3, and 4 via the needle bar 5, but also drives a looper (not illustrated). The looper reciprocates in a lateral direction in synchronization with an up-and-down movement of the sewing needles 2, 3, and 4. At this time, the sewing needles 2, 3, and 4 are fixed to the needle clamp 6 in a state where the sewing needles 2, 3, and 4 are slightly displaced from each other in the up-and-down direction because of a relationship between the position of the looper and the position of each of the sewing needles 2, 3, and 4.

For this reason, in the present embodiment, regarding the positions of eyes 2*h*, 3*h*, and 4*h* of the sewing needles 2, 3, and 4, the eye 2*h* of the left needle 2 is at a lowest position, the eye 4*h* of the right needle 4 is at a highest position, and the eye 3*h* of the middle needle 3 between the left needle 2 and the right needle 4 is at an intermediate height position.

Figure 2:
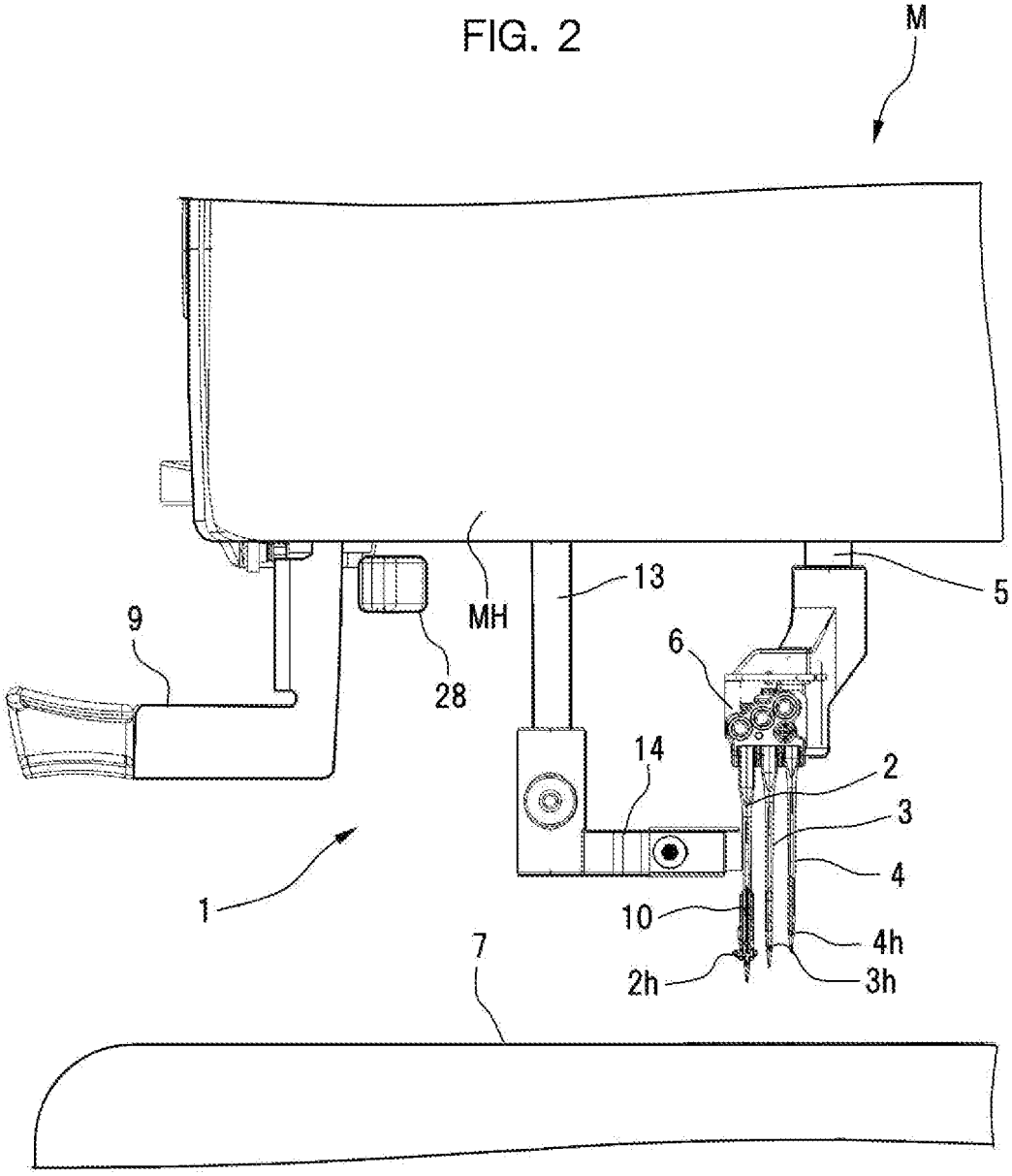
FIG. 2 is a descriptive front view illustrating a main part of the sewing machine of the embodiment of the present invention in a state where the thread hooking claw is lowered.

The threading device 1 is operated when the work of threading the eyes 2*h*, 3*h*, 4*h* of the sewing needles 2, 3, and 4 is performed, and includes an up-and-down movement operation lever 9 to be operated by a user, and a thread hooking claw 10 to be lowered by a lowering operation of the up-and-down movement operation lever 9 as illustrated in FIG. 2.

Figure 3:
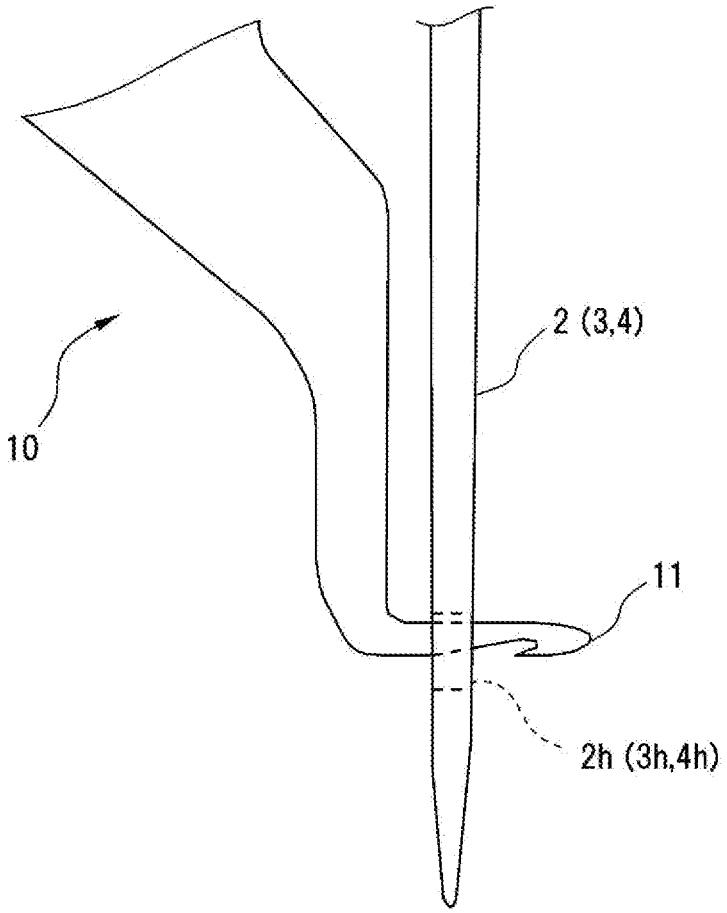
FIG. 3 is a descriptive view illustrating a state where a part of the thread hooking claw is inserted into an eye of a sewing needle.

As illustrated in FIG. 3, the thread hooking claw 10 includes a tip claw portion 11 formed in a hook shape, and is capable of hooking a thread on the tip claw portion 11 in a state where the thread hooking claw 10 is inserted into the eye 2*h* of the sewing needle 2.

Figure 4:
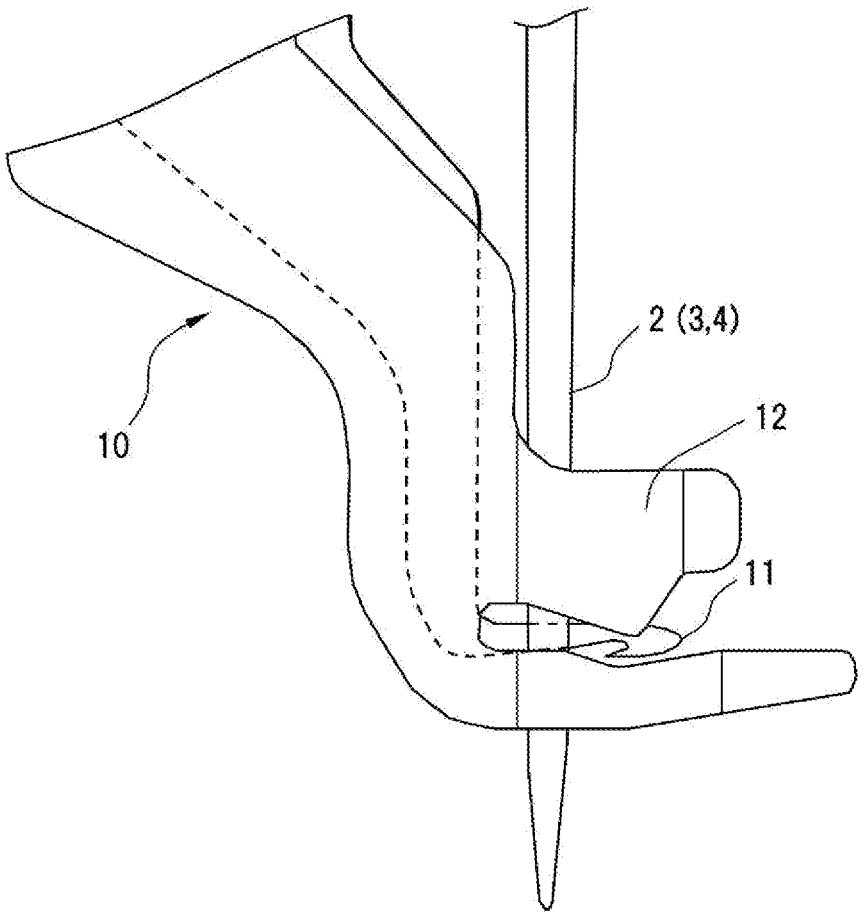
FIG. 4 is an enlarged descriptive view illustrating the thread hooking claw.

In addition, as illustrated in FIG. 4, the thread hooking claw 10 includes a pair of guide pieces 12 covering both sides of the tip claw portion 11. The pair of guide pieces 12 smoothly align the tip claw portion 11 of the thread hooking claw 10 located between both the guide pieces 12 with the eye 2*h* of the sewing needle 2. Incidentally, FIGS. 3 and 4 illustrate a state where the thread hooking claw 10 is inserted into the sewing needle 2, and the thread hooking claw 10 is to be similarly inserted into the other sewing needles 3 and 4 as well.

Figure 5:
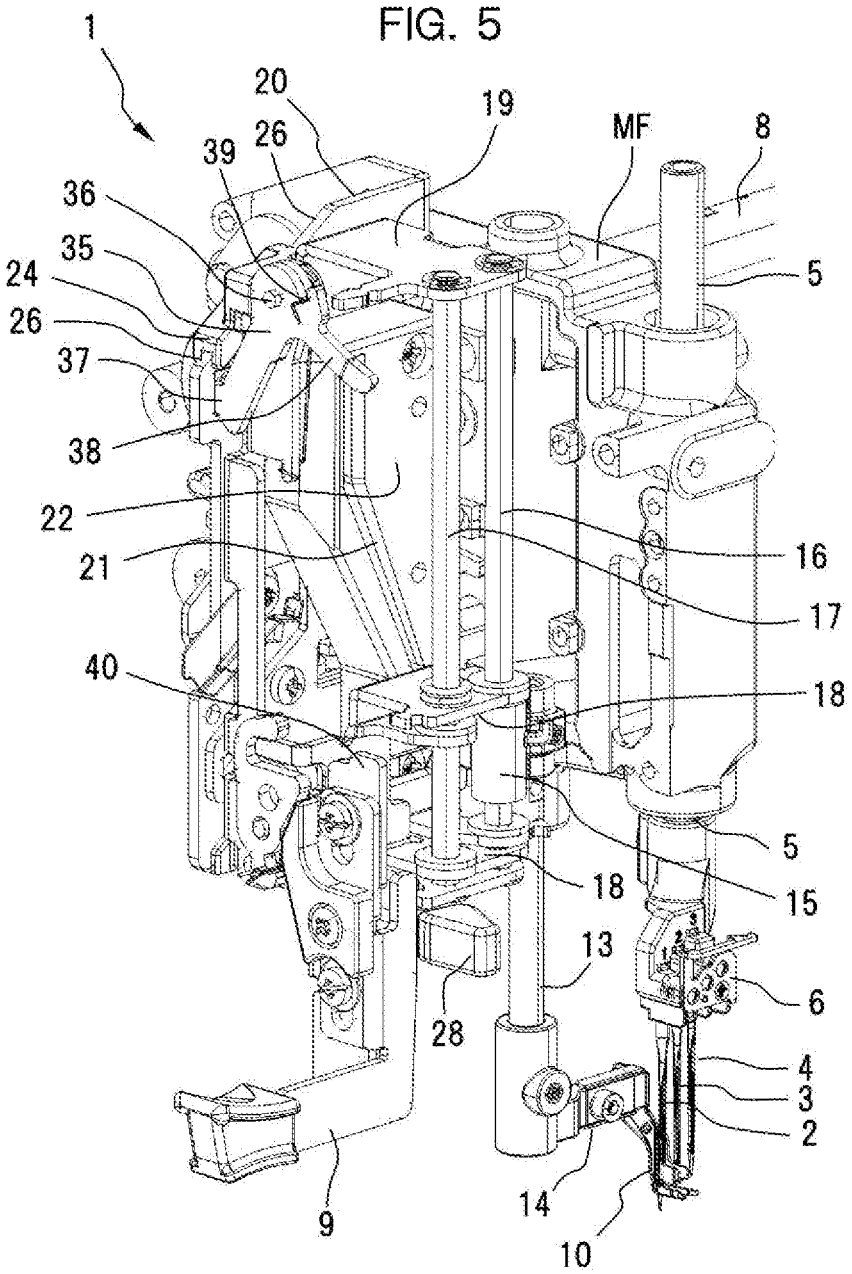
FIG. 5 is a perspective view of a threading device in a state where the thread hooking claw is lowered in the present embodiment as viewed from a support frame side.

As illustrated in FIG. 5, the thread hooking claw 10 is supported by a lower end portion of a thread hooking support rod 13 extending in the up-and-down direction via an extension member 14 extending in the lateral direction. An upper end portion of the thread hooking support rod 13 is connected to a sliding member 15. The sliding member 15 is held so as to be slidable along a longitudinal direction (up-and-down direction) of a thread hooking guide shaft 16 extending in the up-and-down direction.

Further, the sliding member 15 is rotatable around an axis of the thread hooking guide shaft 16. Since the sliding member 15 is rotatable, the thread hooking support rod 13 rotates around the axis of the thread hooking guide shaft 16, together with the sliding member 15.

The axes of the thread hooking guide shaft 16 and the thread hooking support rod 13 are parallel to each other. In addition, a lever guide shaft 17 that guides the up-and-down movement operation lever 9 is disposed beside the thread hooking guide shaft 16. The lever guide shaft 17 is provided parallel to the thread hooking guide shaft 16. The up-and-down movement operation lever 9 is connected to the sliding member 15 by a connecting member 18.

Upper ends and lower ends of both the thread hooking guide shaft 16 and the lever guide shaft 17 are fixed to a support frame 19. As illustrated in FIGS. 5 to 8, the support frame 19 is laterally movably held by a fixed frame 20. The fixed frame 20 is fixed to a machine frame MF of the sewing machine M.

Figure 9:
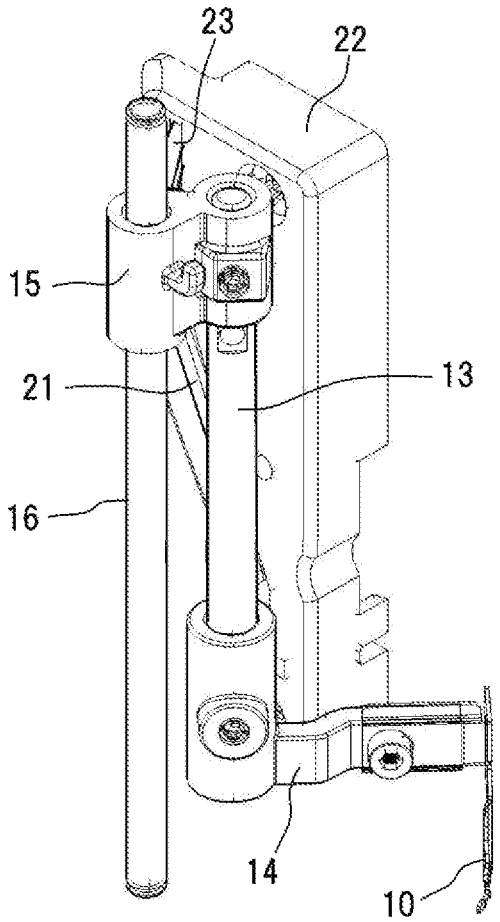
FIG. 9 is a descriptive perspective view illustrating a thread hooking support rod in a state where a sliding member of the threading device is raised in the present embodiment.
Figure 10:
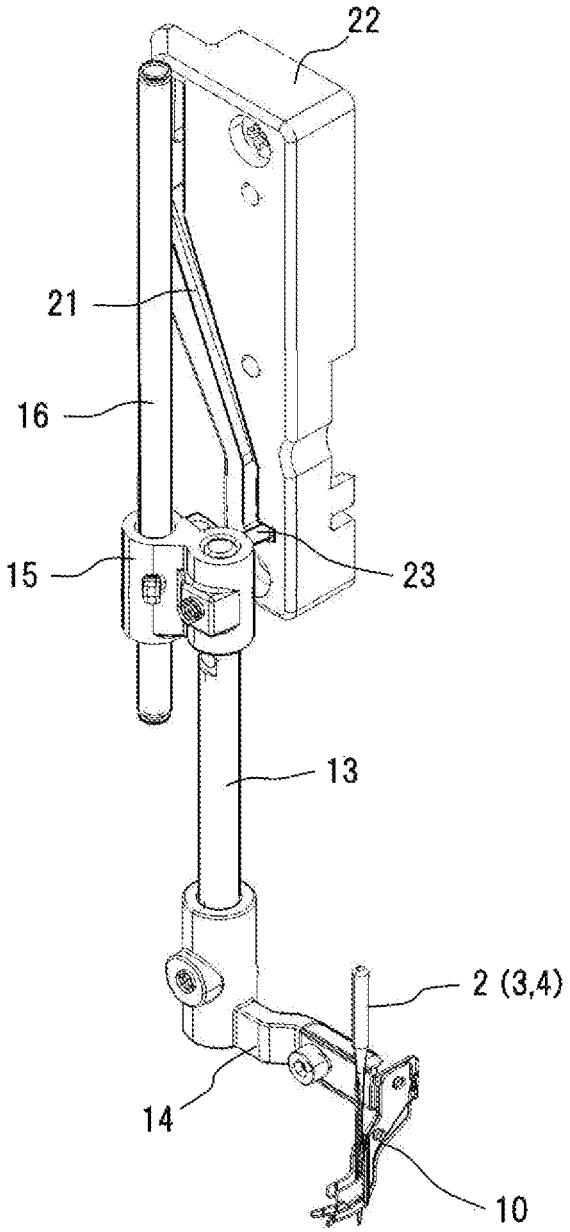
FIG. 10 is a descriptive perspective view illustrating the thread hooking support rod and the thread hooking claw in a state where the sliding member of the threading device is lowered in the present embodiment.

As illustrated in FIGS. 9 and 10, a block member 22 in which a guide groove 21 is formed is provided on an upright surface of the support frame 19. The guide groove 21 guides a sliding pin 23 provided in the sliding member 15. When the sliding pin 23 is guided by the guide groove 21, the sliding member 15 rotates according to the position of the sliding pin 23 (direction in which the sliding pin 23 extends), and the thread hooking support rod 13 and the thread hooking claw 10 connected to the sliding member 15 also rotate. The guide groove 21 and the sliding pin 23 correspond to rotating unit of the present invention.

The position of the sliding pin 23 in the guide groove 21 changes according to the height of the sliding member 15. The height of the sliding member 15 is changed by operation of the up-and-down movement operation lever 9.

Namely, as illustrated in FIG. 9, when the sliding member 15 is at a raised position, the thread hooking claw 10 is retracted depending on the position of the sliding pin 23 in the guide groove 21. As illustrated in FIG. 1, the thread hooking claw 10 is hidden inside a housing MH of the sewing machine M at the retracted position. At this time, the thread hooking support rod 13 supporting the thread hooking claw 10 rises to an upper end position of the thread hooking guide shaft 16 via the sliding member 15, and does not protrude further upward. Accordingly, the thread hooking support rod 13 is storable in a small space when the thread hooking claw 10 is raised and retracted, and a configuration of the thread hooking support rod 13 becomes compact.

Since the thread hooking claw 10 is retracted in a state where the thread hooking claw 10 is hidden inside the housing MH, there is no obstacle to sewing work around the sewing needles 2, 3, and 4 and the needle bar 5, and since a wide work space can be secured, sewing work can be smoothly performed. Therefore, the thread hooking claw 10 with the above configuration can be suitably adopted for the coverstitch sewing machine M that applies a coverstitch around a cuff and a collar of a cloth.

Then, as illustrated in FIG. 10, when the up-and-down movement operation lever 9 is operated to move the sliding member 15 to a lowered position and to lower the thread hooking claw 10, due to operation of the sliding pin 23 guided by the guide groove 21, the thread hooking claw 10 faces a direction to be inserted into the eye 2*h* (3*h*, 4*h*) of the sewing needle 2 (3, 4). At the same time, as illustrated in FIG. 2, the thread hooking claw 10 is inserted into one eye 2*h* (3*h*, 4*h*) of the sewing needles 2 (3, 4) which the thread hooking claw 10 faces at the lowered position, and performs threading work.

Figure 6:
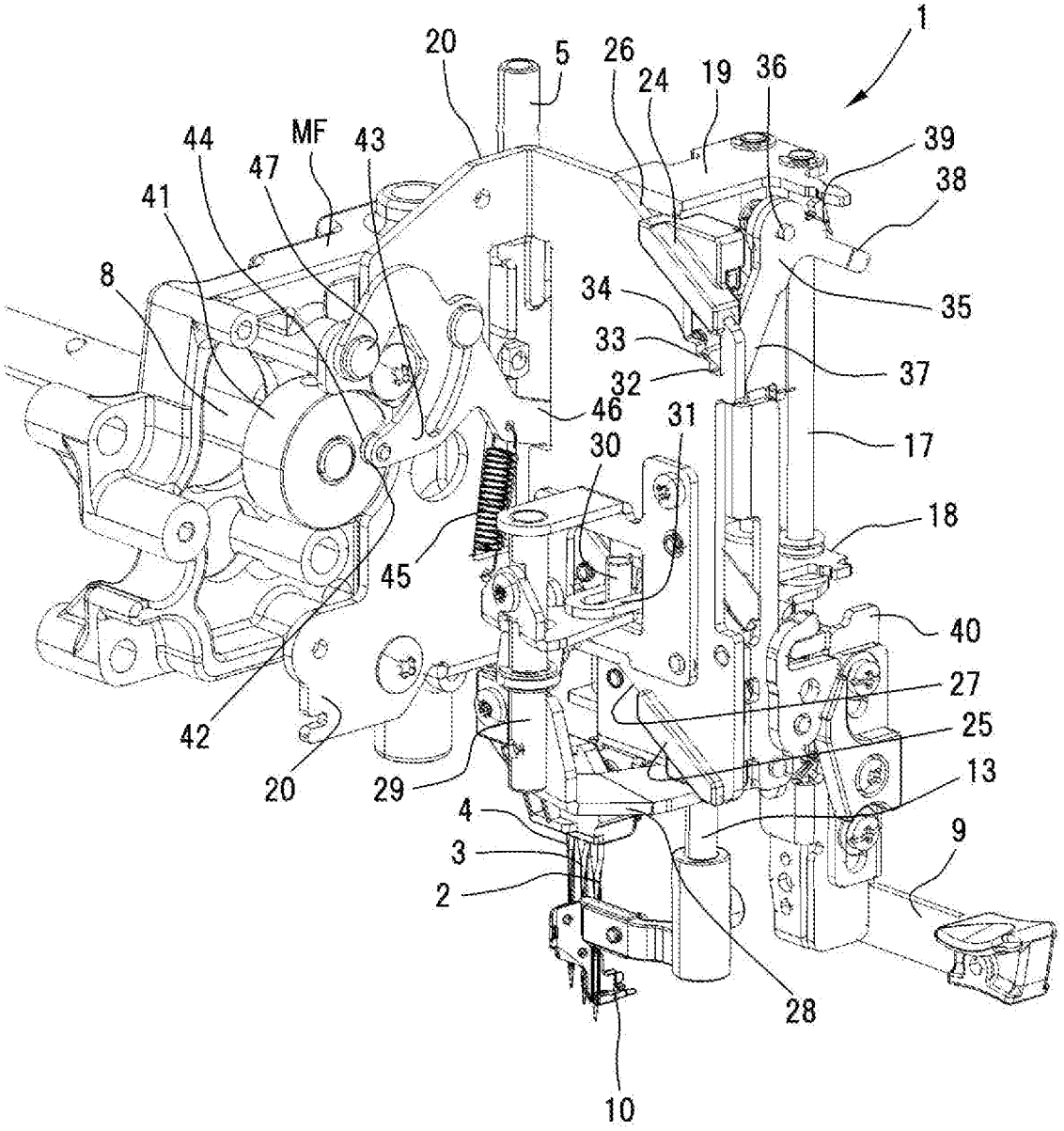
FIG. 6 is a perspective view of the threading device in a state where the thread hooking claw is lowered in the present embodiment as viewed from a fixed frame side.
Figure 8:
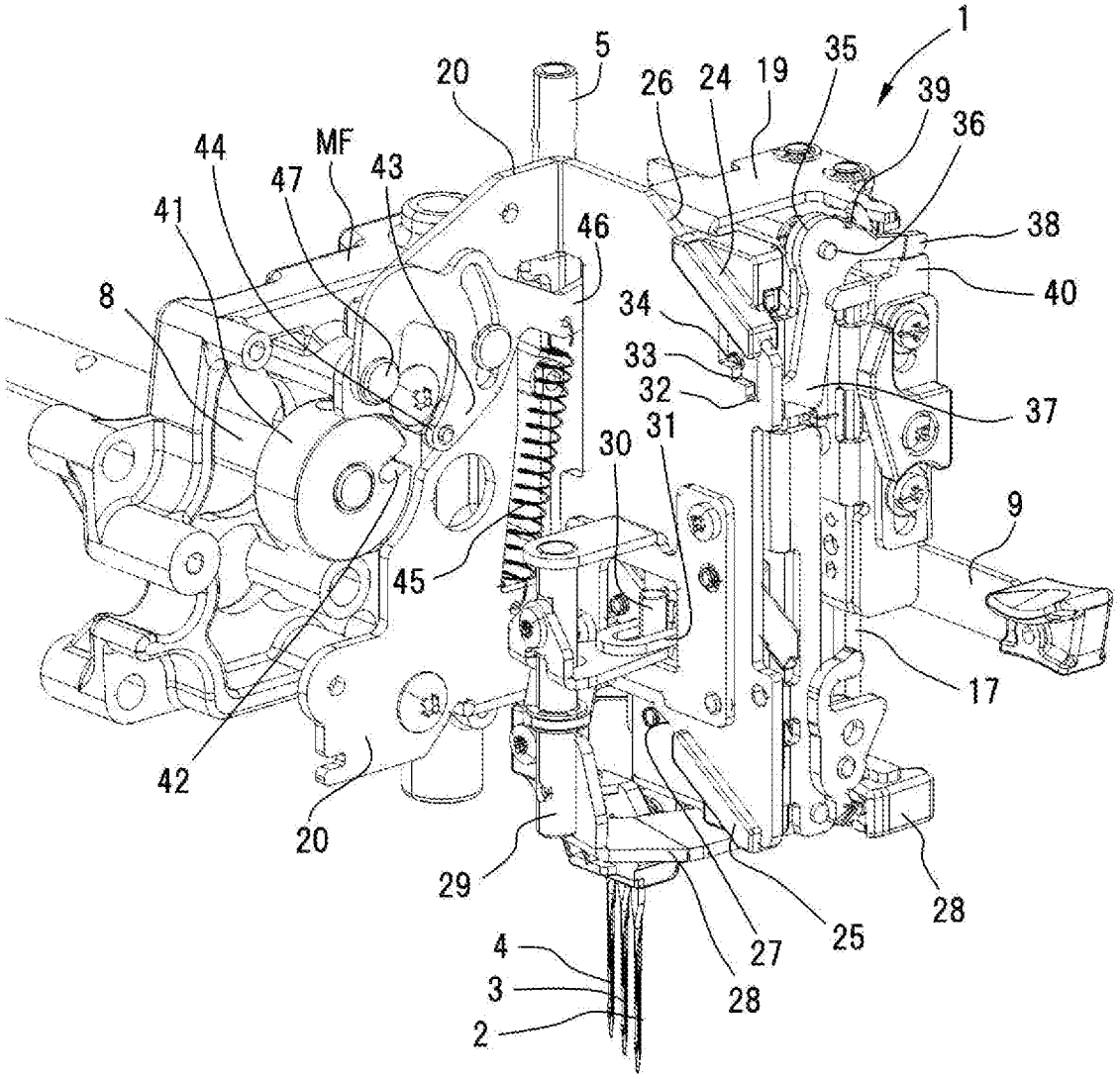
FIG. 8 is a perspective view of the threading device in a state where the thread hooking claw is raised in the present embodiment as viewed from the fixed frame side.

As illustrated in FIGS. 6 and 8, the support frame 19 includes a pair of slide portions 24 and 25 that interpose an upper edge and a lower edge of the fixed frame 20 from above and from below. Inclined portions 26 and 27 that are inclined outward are formed at the upper edge and the lower edge of the fixed frame 20, respectively, and the slide portions 24 and 25 slide along inclinations of the inclined portions 26 and 27. Accordingly, the support frame 19 moves laterally in an oblique direction in a state where the support frame 19 is held by the fixed frame 20.

Since the support frame 19 moves laterally in the oblique direction, the thread hooking claw 10 is movable to a position corresponding to a desired sewing needle of a plurality (three in the present embodiment) of the sewing needles 2, 3, and 4.

The support frame 19 is laterally movable by operation of a lateral movement operation lever 28 illustrated in FIG. 5. As illustrated in FIG. 1, the lateral movement operation lever 28 is exposed below the housing MH of the sewing machine M.

As illustrated in FIG. 8, the lateral movement operation lever 28 is connected to the support frame 19 via a turning shaft 29 that is pivotally supported by the fixed frame 20, an upright pin 30 that turns around an axis of the turning shaft 29 in response to the rotation of the turning shaft 29, and a link piece 31 including an elongated hole into which the upright pin 30 is inserted. The link piece 31 is fixed to the support frame 19, and is laterally moved integrally with the support frame 19 in the oblique direction.

At this time, the upright pin 30 penetrates through the link piece 31 so as to be movable upward, and a relative movement of the upright pin 30 in the up-and-down direction is not restricted, so that the upright pin 30 is not affected by a movement of the support frame 19 in the oblique direction. Therefore, an operation direction of the lateral movement operation lever 28 can be set horizontally, and when the lateral movement operation lever 28 is operated in a horizontal direction, the support frame 19 is laterally movable in the oblique direction.

Figure 7:
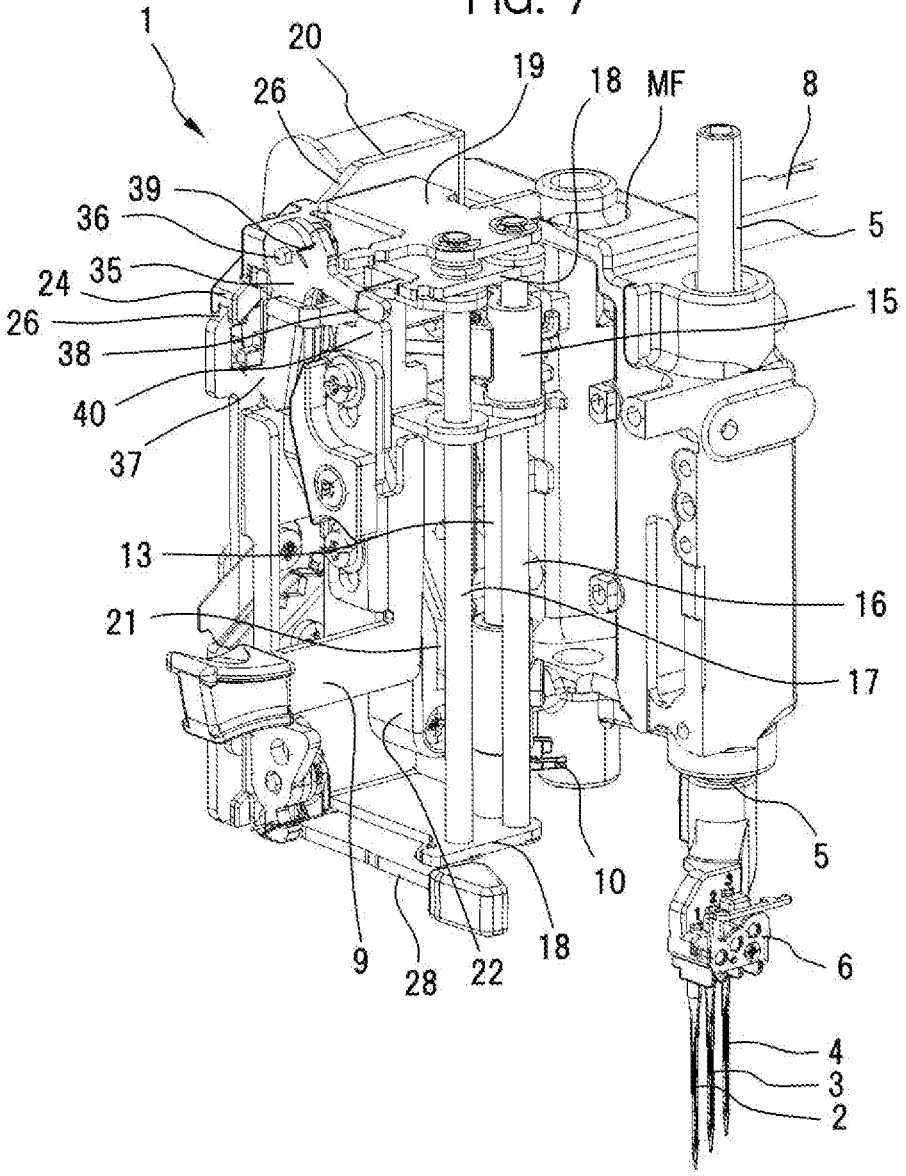
FIG. 7 is a perspective view of the threading device in a state where the thread hooking claw is raised in the present embodiment as viewed from the support frame side.

By the way, when the support frame 19 moves in a state where the thread hooking claw 10 is inserted into one of the eyes 2*h*, 3*h*, and 4*h* of the sewing needles 2, 3, and 4, the thread hooking claw 10 or the sewing needles 2, 3, and 4 may be damaged, which is a concern. Therefore, in the present embodiment, three engaging holes 32, 33, 34 formed in the fixed frame 20 are provided as illustrated in FIGS. 6 and 8, and a locking member 35 that is pivotally attached to the support frame 19 is provided as illustrated in FIGS. 5 and 7. The locking member 35 and the engaging holes 32, 33, 34 form stopping unit in the present invention.

As illustrated in FIGS. 6 and 8, the engaging holes 32, 33, 34 are provided in an inclined arrangement corresponding to stop positions of the support frame 19, and are configured such that three holes having different heights are continuously formed adjacent to each other. A lateral movement of the support frame 19 is releasably and temporarily stopped at positions (three locations in the present embodiment) corresponding to the sewing needles 2, 3, and 4 by a click mechanism (not illustrated). At this time, a temporary stop position is a position corresponding to each of the sewing needles 2, 3, and 4.

As illustrated in FIGS. 5 and 7, the locking member 35 is provided so as to be swingable by a pivot 36, and includes a locking claw piece 37 that swings toward the fixed frame 20, and an abutting piece 38 extending to a position which is different from a position of the locking claw piece 37 via the pivot 36. The locking claw piece 37 faces one of the engaging holes 32, 33, 34 when the support frame 19 is moved to the temporary stop position by the click mechanism.

As illustrated in FIG. 5, when the locking claw piece 37 locks to one of the engaging holes 32, 33, 34, the support frame 19 is immovably stopped at a position corresponding to the locked one of the engaging holes 32, 33, 34. The locking claw piece 37 is biased by a spring member 39 in a direction to engage with the engaging holes 32, 33, 34. The abutting piece 38 is provided at a position where the abutting piece 38 abuts a pressing portion 40 that moves up and down integrally with the up-and-down movement operation lever 9.

As illustrated in FIG. 7, when the pressing portion 40 is at a raised position, the abutting piece 38 is pushed up against the biasing of the spring member 39, and the locking claw piece 37 is separated from the engaging holes 32, 33, 34. When the pressing portion 40 starts to be lowered and reaches a predetermined height position, the pushed-up state of the abutting piece 38 is released, the biasing of the spring member 39 causes the locking claw piece 37 to swing toward the engaging holes 32, 33, 34, and the locking claw piece 37 engages with one of the engaging holes 32, 33, 34.

Namely, according to the above configuration, as illustrated in FIG. 5, when an upward movement operation of the up-and-down movement operation lever 9 causes the pressing portion 40 to reach the raised position, the abutting piece 38 abuts the pressing portion 40 and is pushed up at the same time as the thread hooking claw 10 is raised, and a movement of the support frame 19 is allowed. When the lateral movement operation lever 28 is operated in this state, the thread hooking claw 10 is movable above the position corresponding to the desired sewing needle of the sewing needles 2, 3, and 4.

In addition, when a downward movement operation of the up-and-down movement operation lever 9 causes the pressing portion 40 to start to be lowered, as illustrated in FIG. 7, the abutting of the abutting piece 38 against the pressing portion 40 is released at the same time as the thread hooking claw 10 is lowered, and the support frame 19 is stopped. In this state, even when the lateral movement operation lever 28 is operated, the thread hooking claw 10 does not move. Moreover, when a downward movement operation of the up-and-down movement operation lever 9 is started, the locking claw piece 37 engages with the engaging holes 32, 33, 34, so that an inadvertent movement of the thread hooking claw 10 is prevented even during a downward movement operation of the up-and-down movement operation lever 9.

In such a manner, when thread hooking work is performed by the thread hooking claw 10, the thread hooking claw 10 does not inadvertently move laterally, so that damage to the thread hooking claw 10 or the sewing needles 2, 3, and 4 can be prevented.

In addition, when the sewing needles 2, 3, and 4 reciprocate up and down in a state where the thread hooking claw 10 is inserted into the eyes 2*h*, 3*h*, and 4*h* of the sewing needles 2, 3, and 4, the thread hooking claw 10 or the sewing needles 2, 3, and 4 may be damaged, which is a concern. Therefore, in the present embodiment, as illustrated in FIGS. 6 and 8, the rotation of a flywheel 41 can be locked by engaging an engaging member 43 with an engaging recess 42 formed in the flywheel 41. The engaging recess 42 and the engaging member 43 form locking unit of the present invention.

The engaging member 43 is provided on the fixed frame 20 so as to be swingable via a pivot 47. The engaging member 43 includes a protrusion 44 that engages with the engaging recess 42, and the protrusion 44 is biased by a spring member 45 in a direction to engage with the engaging recess 42.

The engaging member 43 includes an extension piece 46 extending toward a support frame 19 side from a position that is different from a position of the protrusion 44.

A push-up member (not illustrated) that abuts the extension piece 46 to push up the extension piece 46 against the biasing of the spring member 45 is connected to the up-and-down movement operation lever 9. When the extension piece 46 is pushed up, as illustrated in FIG. 8, the engaging member 43 swings, the protrusion 44 separates from the engaging recess 42, and the flywheel 41 is unlocked. Namely, when the up-and-down movement operation lever 9 is at the raised position and the thread hooking claw 10 is at the retracted position (inside the housing MH), the rotation of the main shaft 8 is allowed.

On the other hand, when the up-and-down movement operation lever 9 is lowered, the pushing up of the extension piece 46 by the push-up member is released. Accordingly, as illustrated in FIG. 6, the biasing of the spring member 45 is released to cause the engaging member 43 to swing, and the protrusion 44 engages with the engaging recess 42 to lock the rotation of the main shaft 8.

Then, when the up-and-down movement operation lever 9 is lowered, the thread hooking claw 10 is inserted into one of the eyes 2*h*, 3*h*, and 4*h* of the sewing needles 2, 3, and 4, but at the same time, the rotation of the main shaft 8 is locked. Therefore, the sewing needles 2, 3, and 4 can be prevented from moving up and down during thread hooking work.

INDUSTRIAL APPLICABILITY

The sewing machine threading device of the present invention can be suitably adopted for a sewing machine including a plurality of sewing needles such as an overlock sewing machine or a coverstitch sewing machine to thread smoothly each sewing needle. Moreover, since the thread hooking claw at the raised position does not interfere with the fingers of a worker during correction work, sewing work can be smoothly performed.

DESCRIPTION OF REFERENCE NUMERALS

M sewing machine
MF machine frame
1 threading device
2, 3, 4 sewing needle
2*h*, 3*h*, 4*h* Eye
9 up-and-down movement operation lever
10 thread hooking claw
13 thread hooking support rod
15 sliding member
16 thread hooking guide shaft
19 support frame
20 fixed frame
21 guide groove (rotating unit)
23 sliding pin (rotating unit)
28 lateral movement operation lever
32, 33, 34 engaging hole (stopping unit)
35 locking member (stopping unit)
42 engaging recess (locking unit)
43 engaging member (locking unit)

The invention claimed is:

1. A sewing machine threading device that is provided in a sewing machine including a plurality of sewing needles to thread an eye of each of the sewing needles, the device comprising:

a fixed frame fixed to a machine frame of the sewing machine;

a support frame that is laterally movably held by the fixed frame;

a thread hooking guide shaft of which upper and lower ends in a longitudinal direction are fixed to the support frame;

a sliding member that is slidably held by the thread hooking guide shaft;

a thread hooking support rod of which an upper end portion is connected to the sliding member, of which an lower end portion supports a thread hooking claw, and that extends parallel to the thread hooking guide shaft in an up-and-down direction, the thread hooking claw having a shape to be insertable into and removable from the eye of the sewing needle;

an up-and-down movement operation lever configured to move the thread hooking support rod up and down along the thread hooking guide shaft via the sliding member;

a rotating unit configured to rotate the thread hooking support rod around an axis of the thread hooking guide shaft via the sliding member;

a lateral movement operation lever configured to move laterally the support frame to cause the thread hooking claw to correspond selectively to any one of the sewing needles; and a stopping unit configured to stop a lateral movement of the support frame when the thread hooking claw is at a lowered position, wherein the thread hooking support rod is set to be equal to or less than a length of the thread hooking guide shaft, when the up-and-down movement operation lever is at a raised position, the thread hooking claw is at a retracted position above the sewing needle, when the up-and-down movement operation lever is lowered, the sliding member slides along the thread hooking guide shaft to cause the thread hooking claw to be lowered together with the thread hooking support rod, the rotating unit rotates the thread hooking claw from behind the sewing needle toward the eye of the sewing needle in connection with lowering of the thread hooking support rod, and the thread hooking claw is inserted into the eye of the sewing needle, and the stopping unit allows a lateral movement of the support frame when the up-and-down movement operation lever is at the raised position, and stops a lateral movement of the support frame prior to lowering of the thread hooking support rod when a downward movement operation of the up-and-down movement operation lever is started.

2. The sewing machine threading device according to claim 1, wherein an up-and-down movement of the sewing needle of the sewing machine is driven by rotation of a driving force transmission shaft, and the sewing machine threading device further comprises a locking unit configured to be locked to the driving force transmission shaft in response to a lowering operation of the up-and-down movement operation lever to lock the rotation of the driving force transmission shaft.

* * * * *